US008337275B2

(12) United States Patent
Martins-Crawbuck et al.

(10) Patent No.: US 8,337,275 B2
(45) Date of Patent: Dec. 25, 2012

(54) ADJUSTABLE BRA

(75) Inventors: Michele Martins-Crawbuck, River Vale, NJ (US); Jack Thekkekara, Alpine, NJ (US); Diana Baradarian, Old Westbury, NY (US); Laura Davidson, Lebanon, NJ (US); Yefim Malakhov, English Town, NJ (US)

(73) Assignee: Redcats USA, L.P., Indianapolis, IN (US)

( * ) Notice: Subject to any disclaimer, the term of this patent is extended or adjusted under 35 U.S.C. 154(b) by 0 days.

(21) Appl. No.: 13/087,437

(22) Filed: Apr. 15, 2011

(65) Prior Publication Data

US 2011/0275277 A1 Nov. 10, 2011

Related U.S. Application Data

(60) Provisional application No. 61/325,292, filed on Apr. 17, 2010.

(51) Int. Cl.
*A41C 3/00* (2006.01)

(52) U.S. Cl. ..... 450/85; 450/62; 450/64

(58) Field of Classification Search ..... 450/71–73, 450/78, 79, 80, 82, 84–86, 64, 62
See application file for complete search history.

(56) References Cited

U.S. PATENT DOCUMENTS 2,156,478 A * 5/1939 Kemp ..... 450/85
2,449,808 A * 9/1948 Glick ..... 450/79
2,521,373 A * 9/1950 Hutchison ..... 450/77
2,585,257 A * 2/1952 Lee ..... 450/68
3,008,468 A * 11/1961 Williams ..... 450/2
3,334,632 A * 8/1967 Rashkin ..... 450/77
4,300,568 A * 11/1981 Blanckmeister ..... 450/85
4,781,651 A 11/1988 Ekins
4,957,466 A 9/1990 Hopps
5,149,293 A 9/1992 Gable
5,180,326 A 1/1993 Williams
5,221,227 A 6/1993 Michels
5,378,192 A * 1/1995 Darmante ..... 450/58
5,429,593 A 7/1995 Matory
5,716,255 A 2/1998 Abercrombie et al.
D393,338 S 4/1998 Rubin
5,749,768 A 5/1998 Green
5,839,942 A 11/1998 Miller
D403,486 S 1/1999 Chetwynd
5,863,236 A 1/1999 Johnson
5,944,579 A 8/1999 Fleischman
6,023,785 A 2/2000 Johnson
6,123,601 A 9/2000 Hildebrandt
6,200,194 B1 3/2001 Grier
6,280,287 B1 8/2001 Keith et al.
6,319,091 B1 11/2001 Kilbride et al.
6,386,944 B2 5/2002 Keith et al.
6,477,713 B2 11/2002 Krause et al.
6,517,409 B2 2/2003 Flaherty
6,547,636 B1 4/2003 Cato
7,056,186 B1 * 6/2006 Weyenberg et al. ..... 450/58
7,232,359 B1 6/2007 Richardson
(Continued)

*Primary Examiner* — Gloria Hale
(74) *Attorney, Agent, or Firm* — Bryan Cave LLP

(57) ABSTRACT

The adjustable bra of the present invention includes an adjustment element that permits adjustment of the length of the front, adjustment of the length of the side, and/or adjustment of the length of the back, and/or adjustment of the cup size. The bra comprises a pair of bra cups and a band, the band comprising a front underbust band attached to and underlying the bra cups, a back band, and a pair of length adjustment elements for independently adjusting the length of the band.

8 Claims, 7 Drawing Sheets

U.S. PATENT DOCUMENTS

| | | | | |
|---|---|---|---|---|
| 7,435,155 | B2 | 10/2008 | Reinisch et al. | |
| 7,448,937 | B2 * | 11/2008 | Weyenberg et al. | 450/63 |
| 7,497,760 | B2 | 3/2009 | Redenius | |
| 7,537,510 | B2 | 5/2009 | Gransberry | |
| 8,167,679 | B2 * | 5/2012 | Seraceno et al. | 450/86 |
| 8,172,639 | B2 * | 5/2012 | Swendseid | 450/85 |
| 2006/0089083 | A1 | 4/2006 | Tonsor | |
| 2009/0044310 | A1 | 2/2009 | Baacke | |
| 2009/0233522 | A1 | 9/2009 | Schlatmann | |
| 2010/0178847 | A1 * | 7/2010 | Buriak | 450/39 |
| 2010/0190411 | A1 * | 7/2010 | Saraceno et al. | 450/39 |
| 2011/0177757 | A1 * | 7/2011 | Swendseid | 450/70 |

* cited by examiner

ADJUSTABLE BRA

CROSS-REFERENCE TO RELATED APPLICATIONS

This application claims the benefit of U.S. Provisional Application Ser. No. 61/325,292, filed Apr. 17, 2010, which is incorporated herein by reference in its entirety.

FIELD OF THE INVENTION

The present invention generally relates to a bra providing a readily adjustable fit to the wearer's torso. More particularly, the present invention is directed to an adjustable bra that allows a wearer to create a comfortable fit by providing a front band, a back band, or both, that is (are) readily adjustable, and by providing various front or back closure elements, and various styles.

BACKGROUND OF THE INVENTION

Bras today are typically sold by bra band and bra cup size. Most manufacturers and retailers offer only a limited selection of combinations, for example, 34A-C, 36B-D, 38C-DD, 40 D-F, etc. This limited size selection makes it difficult for some women to find a bra that fits properly, likely a result of the lack of bra size combinations available and/or the limited flexibility within each bra to accommodate body changes as a function of time (e.g., as a result of dieting or weight gain over time) or fabric changes after multiple uses.

Typically, bras permit shoulder strap adjustment, but shoulder strap adjustment alone may be inadequate to provide enhanced comfort. Consequently, there is a continuing need for a bra that controls overall fit, bust cup capacity, and/or the sides of the busts, together or independently of one another.

SUMMARY OF THE INVENTION

Among the various aspects of the present invention may be noted a unique and advantageous adjustable bra. The adjustable bra of the present invention, for example, has an adjustable band that permits adjustment of the length of the front, side, and/or back, and/or cup size adjustment. Consequently, the adjustable bra offers an improved fit for women having a size between standard sizes or having a disproportionate band to bust ratios (e.g., wide back/shallow front; narrow back/full front), and it offers an improved fit for a woman's changing bra needs for dieting and weight gain and other factors that may influence size or fit.

Briefly, therefore, the present invention is directed to a bra comprising a pair of bra cups and a band. The band comprises a front underbust band attached to and underlying the bra cups, a back band, and a pair of length adjustment elements for independently adjusting the length of the band.

Other objects and features will be in part apparent and in part pointed out hereinafter.

DETAILED DESCRIPTION OF THE INVENTION

Figure 1:
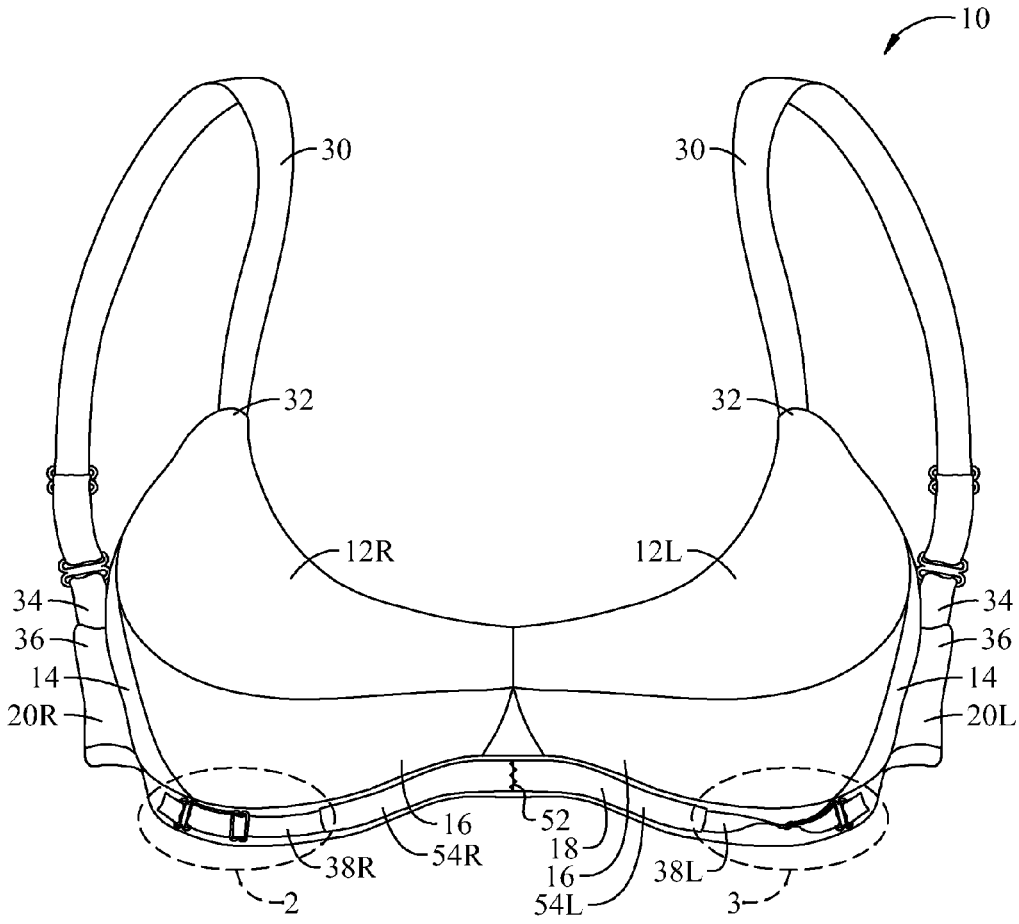
FIG. 1 is a front perspective view of a bra of the present invention.

In FIG. 1 there is shown an adjustable bra generally denoted by the numeral 10 corresponding to one embodiment of the present invention. Adjustable bra 10 comprises a first bra cup 12R, a second bra cup 12L, and a band. The band consists of front underbust band 18, back band 20R (See FIG. 4) and back band 20L (See FIG. 4). Typically, the length of the band will be within the range of about 30 inches (75 cm) to 58 inches (150 cm), although greater or lesser lengths are within the scope of the invention.

Each bra cup 12R, 12L has an outer side portion 14, and a lower portion 16. The lower portions 16 of bra cups 12R and 12L are joined to front underbust band 18 that extends from the outer side portion 14 of bra cup 12R to outer side portion 14 of bra cup 12L. Preferably, the bra cups and front underbust band element are made of woven or knit fabric, foam, cotton, silk, polyester, microfiber, lycra, nylon, spandex, lace, satin, fiberfill or other suitable materials. Bra cups 12R and 12L may range, for example, from size A to H.

Figure 4:
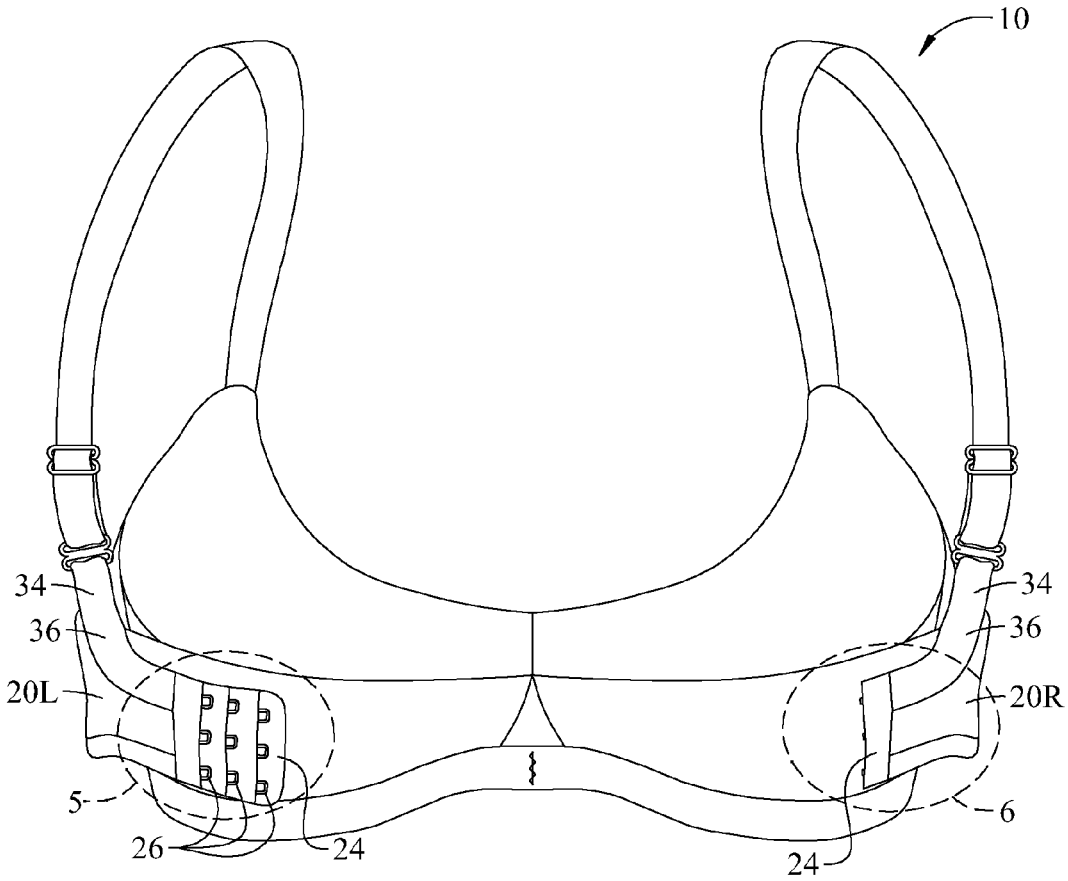
FIG. 4 is a back perspective view of the bra of FIG. 1.
Figure 5:
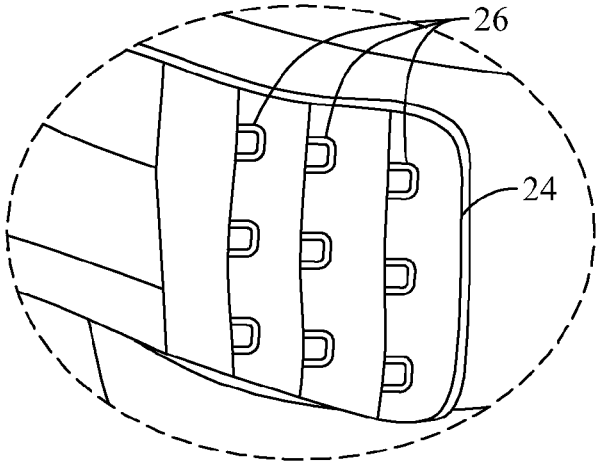
FIG. 5 is a view of one of the closure elements of the bra of FIG. 1.
Figure 6:
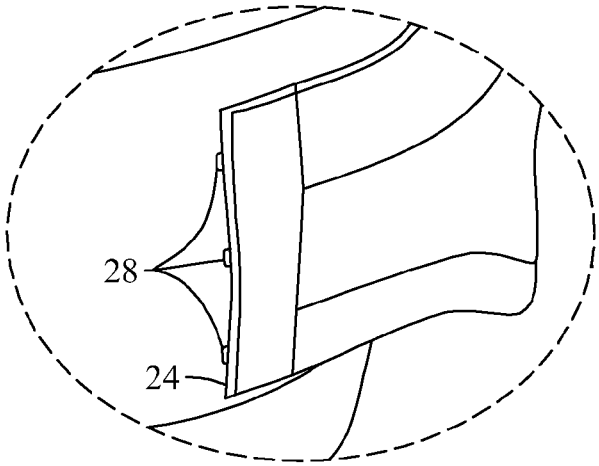
FIG. 6 is a view of one of the closure elements of the bra of FIG. 1.
Figure 7:
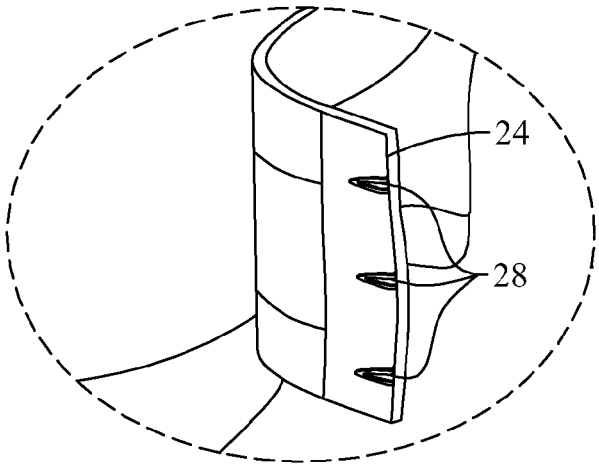
FIG. 7 is a view of one of the closure elements of the bra of FIG. 1.
Figure 11:
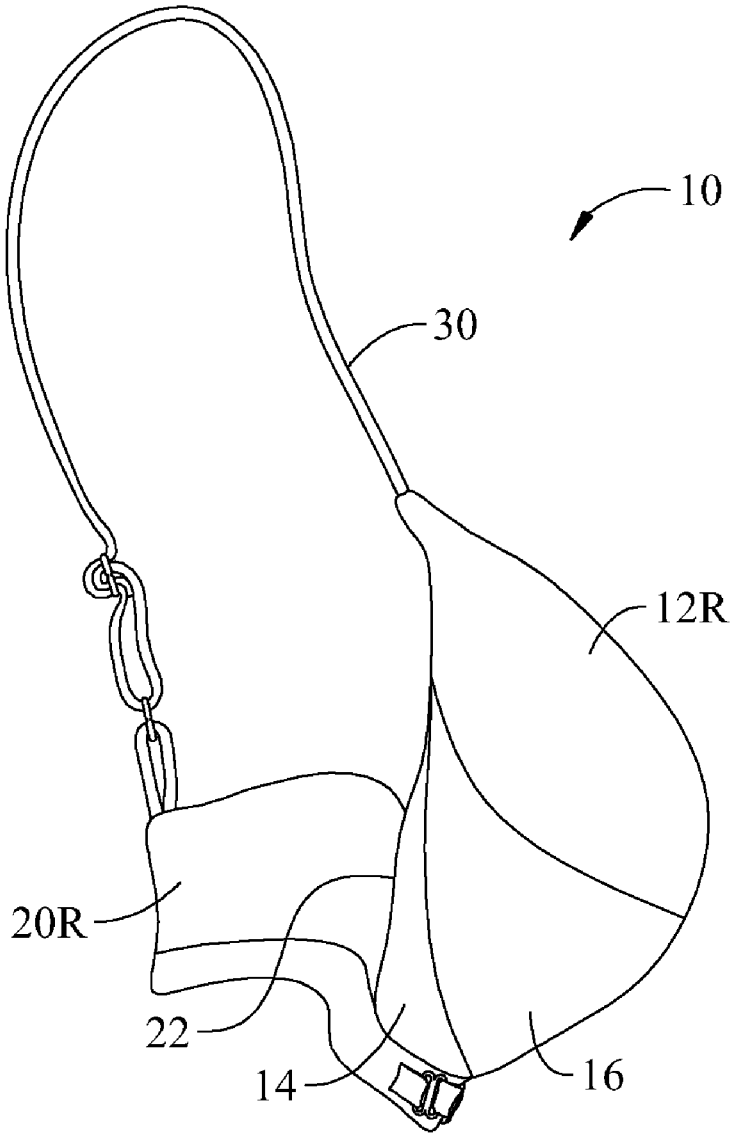
FIG. 11 is a side perspective view of the bra of FIG. 1.

The adjustable bra 10 further comprises a first back band 20R and a second back band 20L. FIG. 4 is a rear perspective view of the adjustable bra of FIG. 1 showing the back bands. Each back band 20R, 20L has a first end 22 (see FIG. 11) extending from the outer side portions 14 of the first and second bra cups 12R, 12L. As illustrated in FIG. 11, back band 20R is joined to outer side portion 14 of bra cup 12R by a line of stitching; in other embodiments, each of the back bands 20R and 20L may be extend, as a continuous piece of fabric from side portions 14 of bra cups 12R and 12L. Each back band 20R, 20L also has a second free end 24. Preferably, the back bands are made of woven or knit fabric, foam, cotton, silk, polyester, microfiber, lycra, nylon, spandex, lace, satin, or other suitable materials.

As shown in FIGS. 4-7, free end 24 of back band 20R has a back closure element 26 comprising a series of rows of loops (eyes) and free end 24 of back band 20L has a complementary back closure element comprising a row of hooks 28. When the back closure element 26 is coupled to the complementary back closure element 28, the first and second back bands 20R, 20L are connected and extend around the torso and back of a wearer. In the embodiment illustrated in FIG. 4, back closure element 26 comprises three rows of loops (eyes), with three loops (eyes) per row, and back closure element 28 comprises a row of three hooks. In general, the number of rows of loops (eyes) and the number of loops per row is generally a function of bra size, with the number of rows and/or the number of loops (eyes) per row increasing as the bra size increases and number of rows and/or the number of loops (eyes) per row decreasing as the bra size decreases. Other complementary back closure elements, such as snaps, clasps, clamps, buttons, rings, ties, zippers, metal slides or clips may also be used instead of hooks and loops (eyes).

Preferably, the back closure elements are made of plastic, metal, rubber or other suitable materials.

As illustrated in FIG. 1, the adjustable bra 10 further comprises a pair of adjustable shoulder straps 30. Each shoulder strap 30 has a first end 32 and a second end 34. Preferably, the shoulder straps are made of woven or knit fabric, foam, cotton, silk, polyester, microfiber, lycra, nylon, spandex, lace, satin, fiberfill, plastic (for example, clear plastic straps) or other suitable materials. Preferably, the first end 32 of each shoulder strap 30 is connected respectively to the upper portions of first and second bra cups 12R, 12L. Each shoulder strap may be permanently attached to the first and second bra cups or connected by a detachable front shoulder strap fastener such as a double hook element, a clasp element, a clamp element, or another suitable strap fastener. Preferably, the second end 34 of each shoulder strap 30 is connected to the top end 36 of the first and second back bands 20R, 20L by a ring. Again, each shoulder strap may be permanently attached to the first and second back bands cups or connected by a detachable front shoulder strap fastener such as a double hook element, a clasp element, a clamp element, or another suitable strap fastener. Further, each shoulder strap 30 may further include a bra slide or other strap length adjustment element between the first and second ends of the strap for adjusting the length of each shoulder strap 30; in one embodiment, for example, the length of the shoulder straps may be adjusted from 1 inch (2.5 cm) to about 5 inches (12.5 cm), with about up to about 3 inches (7.5 cm) being typical. For example, in certain embodiments the length adjustment element may permit an adjustment of about 3 inches (7.5 cm)+/−5 inches (12.5 cm). Preferably, bra slide or other strap length adjustment element is made of plastic, metal, rubber or other suitable materials.

In a preferred embodiment, front underbust band 18 comprises a pair of tunnels 54R and 54L. Tunnels 54R and 54L may be formed, for example, by stitching a second piece of fabric onto the top of front underbust band 18, with a first line of stitching running along the top of front underbust band 18, a second line of stitching running along the bottom of front underbust band 18, and a third line of stitching at center 52 (with the third line being generally perpendicular to the first and second lines of stitching). In general, tunnels 54R and 54L will each have a length of at least 1 inch (2.5 cm), typically 2-8 inches (5-20 cm).

Adjustable bra 10 further comprises fit adjustment elements 38R and 38L, located along front underbust band 18, permitting independent adjustment of the capacity of cups 12R and 12L and/or the fit of the bra around the torso of the wearer when the first and the first and second back bands 20R, 20L are connected. In general, fit adjustment elements 38R and 38L each permit an adjustment of about 1 inch (2.5 cm) to about 8 inches (20 cm). By way of example, in certain embodiments, fit adjustment elements 38R and 38L each permit an adjustment of at least about 2 inches (5 cm). By way of further example, fit adjustment elements 38R and 38L may each permit an adjustment of at least about 3 inches (7.5 cm). By way of further example, fit adjustment elements 38R and 38L may each permit an adjustment of at least about 4 inches (10 cm). In many embodiments, fit adjustment elements 38R and 38L may each permit an adjustment of about 1 inch (2.5 cm) to about 6 inches (15 cm). For example, in certain embodiments fit adjustment elements 38R and 38L may each permit an adjustment of about 2 inches (5 cm) to about 4 inches (10 cm). For example, in certain embodiments fit adjustment elements 38R and 38L may each permit an adjustment of about 3 inches (7.5 cm)+/−2 inches (5 cm).

Figure 2:
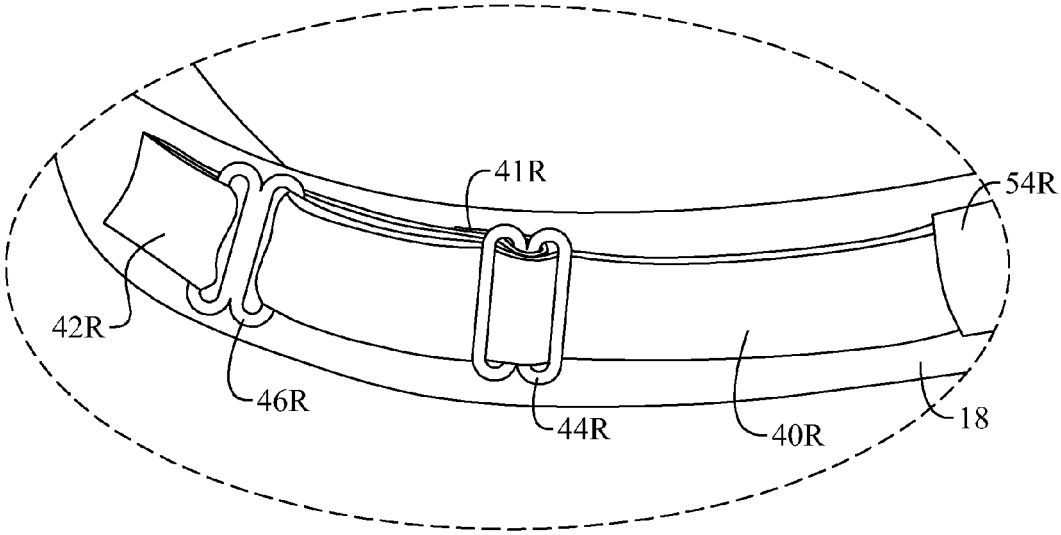
FIG. 2 is a view of one of the length adjustment elements of the bra of FIG. 1.

Fit adjustment element 38R preferably comprises a pair of straps 40R and 42R fastened to each other by a pair of bra slides 44R and 46R. Strap 40R is partially contained within tunnel 54R with one end of strap 40R (not shown) being center stitched to front underbust band 18 at center 52 (see FIG. 1); the other end 41R of strap 40R passes through each of bra slides 44R and 46R and is affixed to bra slide 44R (see FIG. 2). Similarly, strap 42R passes through bra slide 46R and its ends are stitched or otherwise affixed to back band 20R (see FIGS. 2 and 11). Thus, by moving bra slide 44R in the direction of (i.e., closer to) center 52, the length of front underbust band 18 between center 52 and back band 20R is effectively shortened, providing for a tighter fit. Conversely, moving bra slide 44R in the direction of (i.e., closer to) back band 20R, the length of front underbust band 18 between center 52 and back band 20R is effectively lengthened, providing a looser fit.

Figure 3:
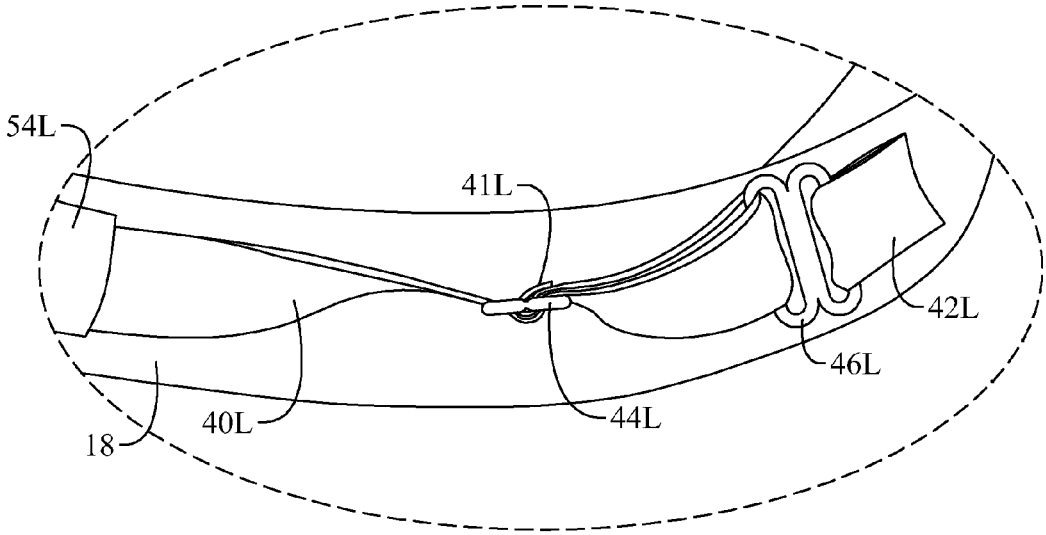
FIG. 3 is a view of a second of the length adjustment elements of the bra of FIG. 1, twisted to show detail.

Referring now to FIGS. 1 and 3, fit adjustment element 38L similarly comprises a pair of straps 40L and 42L fastened to each other by a pair of bra slides 44L and 46L. Strap 40L is partially contained within tunnel 54L with one end of strap 40L (not shown) being center stitched to front underbust band 18 at center 52 of front underbust band 18 (see FIG. 1); the other end 41L of strap 40L passes through each of bra slides 44L and 46L and is affixed to bra slide 44L (see FIG. 3). Similarly, strap 42L passes through bra slide 46L and its ends are stitched or otherwise affixed to back band 20L (see FIGS. 1 and 3). Thus, by moving bra slide 44L in the direction of (i.e., closer to) center 52, the length of front underbust band 18 between center 52 and back band 20L is effectively shortened, providing for a tighter fit. Conversely, moving bra slide 44L in the direction of (i.e., closer to) back band 20L, the length of front underbust band 18 between center 52 and back band 20L is effectively lengthened, providing a looser fit.

Straps 40R, 40L, 42R and 42L are preferably made of woven or knit fabric, foam, cotton, silk, polyester, microfiber, lycra, nylon, spandex, lace, satin, plastic, or other suitable materials. In a particularly preferred embodiment, straps 40R and 40L are elastic.

Referring again to FIG. 1, in a preferred embodiment, front underbust band 18 comprises a pair of tunnels 54R and 54L through which straps 40R and 40L, respectively, pass. Advantageously, when either of bra slides 44R and 44L are moved in the direction of (i.e., closer to) center 52 to achieve a tighter fit, straps 40R and/or 40L will be held, within tunnels 54R and 54L, in juxtaposition with front underbust band 18. In general, tunnels 54R and 54L preferably have a length that is at least 10% of the distance between center 52 and back bands 20R and 20L, respectively. In certain embodiments, tunnels 54R and 54L preferably have a length that is at least 15% of the distance between center 52 and back bands 20R and 20L, respectively. In other preferred embodiments, tunnels 54R and 54L preferably have a length that is at least 25% of the distance between center 52 and back bands 20R and 20L, respectively.

In one embodiment, straps 40R and 40L are two ends of a single piece of material that is vertically stitched at or near its midpoint to front underbust band 18 at the center 52 of front underbust band 18 (see FIG. 1). In other embodiments, straps 40R and 40L are two ends of a single piece of material that is vertically stitched to the front underbust band at one or more position(s) other than the center 52 of front underbust band, e.g., under each of the bra cups. In other embodiments, straps 40R and 40L are two separate pieces of material each of which is vertically stitched to the front underbust band 18 at or near center 52 or at positions other than center 52, e.g., under each of the bra cups.

Figure 8:
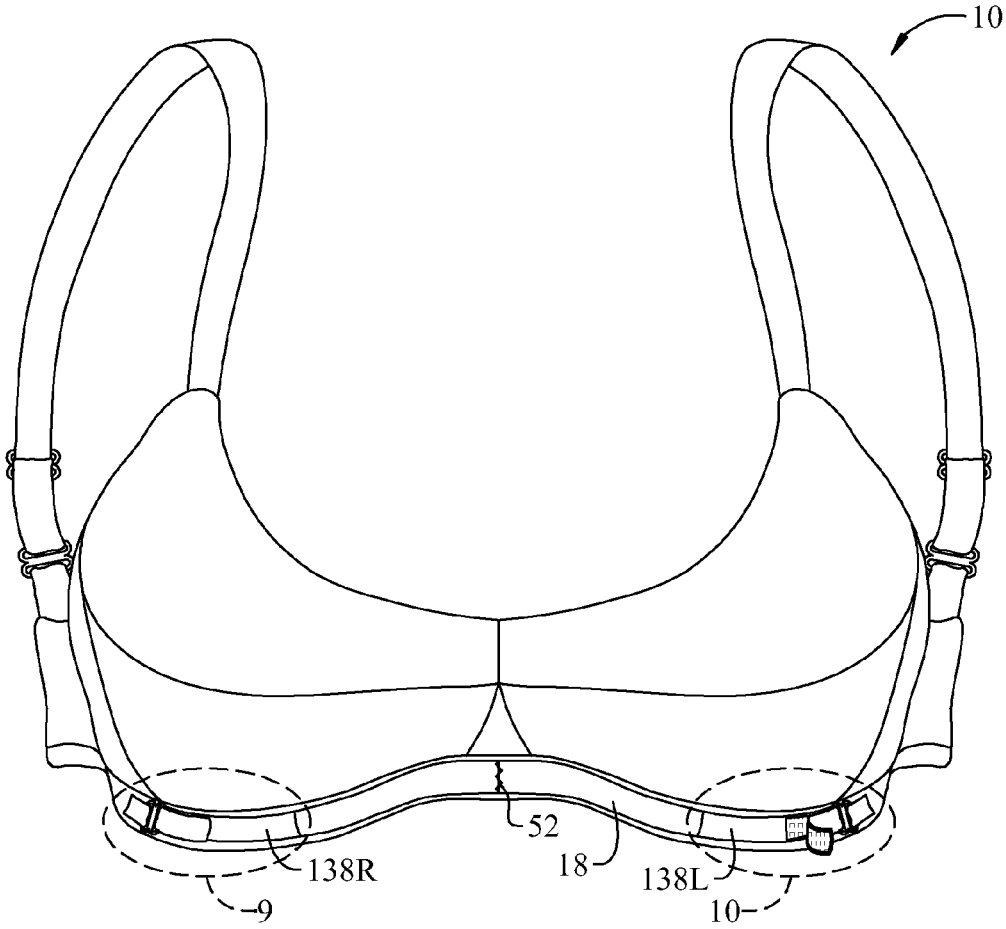
FIG. 8 is front perspective view of an alternative embodiment of the bra of the present invention.
Figure 9:
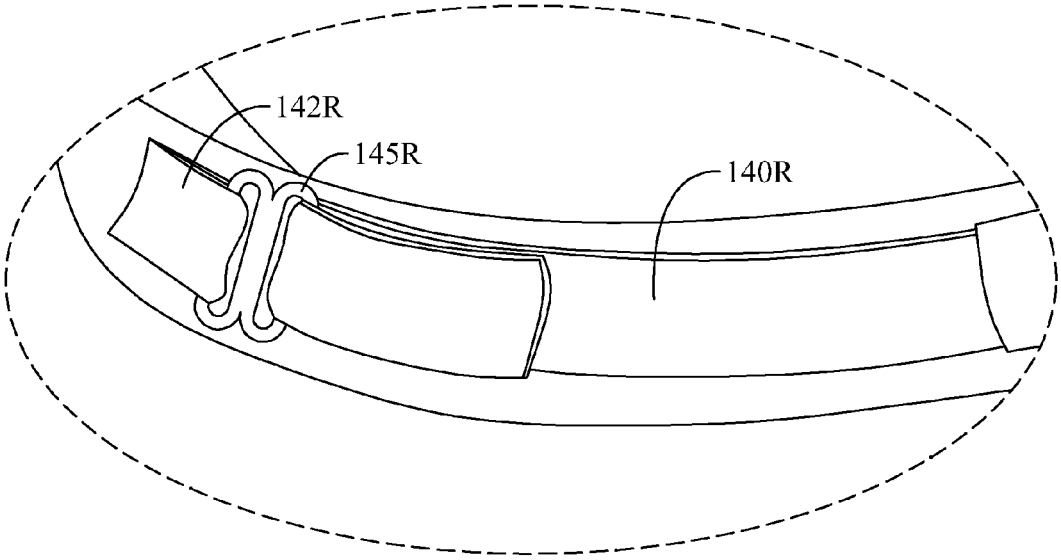
FIG. 9 is a view of one of the length adjustment elements of the bra of FIG. 8.
Figure 10:
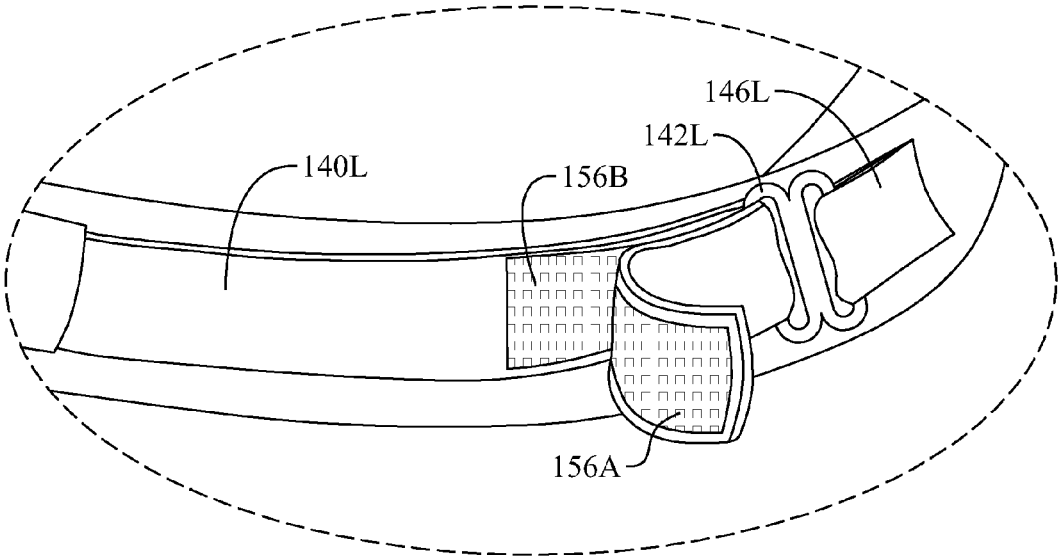
FIG. 10 is a view of a second of the length adjustment elements of the bra of FIG. 8.

FIGS. 8-10 depict an alternative embodiment of the present invention in which fit adjustment elements 138R and 138L comprise Velcro type fasteners. More specifically, fit adjustment element 138L comprises straps 140L and 142L. Strap 140L has fastening areas 156*a* and 156*b* on one side thereof, with one of the fastening areas including a plurality of hooks and the other including a plurality of loops (eyes) with which the hooks are engagable (see FIG. 10). Strap 142L secures bra slide 145L to back band 20L. One end of strap 140L is stitched or otherwise affixed to center 52 of front underbust band 18. The free end of strap 140L is passed through bra slide 145L, and strap 140L is folded back onto itself to engage fastening areas 156*a* and 156*b*. In general, the greater the length of strap 140L that is passed through bra slide 145L, the tighter the fit on the wearer. Similarly, adjustment element 138R comprises straps 140R and 142R. Like strap 140L, strap 140R has fastening areas on one side thereof (not shown), with one of the fastening areas including a plurality of hooks and the other including a plurality of loops (eyes) with which the hooks are engagable. Strap 142R secures bra slide 145R to back band 20R. One end of strap 140R is stitched or otherwise affixed to center 52 of front underbust band 18. The free end of strap 140R is passed through bra slide 145R, and strap 140R is folded back onto itself to engage the fastening areas. In general, the greater the length of strap 140L that is passed through bra slide 145R, the tighter the fit on the wearer. In addition, fit adjustment elements 138R and 138L may be adjusted independently of each other to tailor the fit to the wearer's needs.

While Velcro-type hook and pile fasteners and bra slide style fasteners have been illustrated for use in combination with straps as part of the length adjustment elements, any other type fastener that permits adjustment of the effective length of front underbust band 18 may be used within the scope of the present invention. Thus, for example, buckles, snaps, clasps, clamps, buttons, rings, ties, zippers, metal slides or clips may be used instead.

It will be understood that the independent adjustment feature described herein may be incorporated into strapless bras, underwire bras, sports bras, posture bras, minimizer bras, leisure bras, front closure bras, and the like. When the bra is a front closure bra, for example, the back band will be a single band of material (lacking closure elements) and the front underbust band will comprise two ends that are joined using closure elements (of the type described herein for back closure bras). Thus, when incorporated into a front closure bra, the fit adjustment elements may extend from each of the front closure elements and extend under the bra cups as otherwise disclosed herein.

In an alternative embodiment, any of the fit adjustment elements disclosed herein may be located on the back band(s) rather than the front underbust band. Thus, for example, the independent fit adjustment elements may be located on the back bands of a back closure bra or the back band of a front closure bra; in either embodiment, the independent fit adjustment elements may be positioned one each on each of the back bands of a back closure bra, or on opposite sides of the back band of a front closure bra (e.g., the fit adjustment elements are positioned to lie under or at least proximate each of the shoulder blades, respectively, when the bra is worn).

Having described the invention in detail, it will be apparent that modifications and variations are possible without departing the scope of the invention defined in the appended claims. Furthermore, it should be appreciated that all examples in the present disclosure are provided as non-limiting examples.

What is claimed is:

1. A bra comprising a first bra cup having an outer side portion, a second bra cup having an outer side portion, a front underbust band attached to and underlying the first and second bra cups, a first back band, and a second back band, the first back band having a first end attached to the outer side portion of the first bra cup and a second free end comprising a back closure element, the second back band having a first end attached to the outer side portion of the second bra cup and a second free end having a back closure element, the back closure elements comprised by first and second back bands being complementary and for connecting the free ends of the first and second back bands to encircle a wearer's torso, the front underbust band having a center, a first segment having a length from the center to the first back band, a second segment having a length from the center to the second back band, and a pair of length adjustment elements affixed at the center of the front underbust band for independently adjusting the length of the first and second segments of the front underbust band around the wearer's torso, one of the length adjustment elements being under the first bra cup and the other length adjustment element being under the second bra cup.

2. The bra of claim 1 wherein each of the length adjustment elements comprises a pair of straps.

3. The bra of claim 1 wherein each of the length adjustment elements comprises a pair of straps and a bra slide.

4. The bra of claim 1 wherein the front underbust band comprises a pair of tunnels, one under each bra cup, and each of the length adjustment elements comprises a pair of straps with one member of each pair passing through one of the tunnels.

5. The bra of claim 4 wherein each of the length adjustment elements comprises a pair of straps and a bra slide.

6. The bra of claim 1 further comprising a first adjustable shoulder strap with a first end attached to the first bra cup and a second end attached to the first back band, and a second adjustable shoulder strap with a first end attached to the second bra cup and a second end attached to the second back band.

7. The bra of claim 4 further comprising a first adjustable shoulder strap with a first end attached to the first bra cup and a second end attached to the first back band, and a second adjustable shoulder strap with a first end attached to the second bra cup and a second end attached to the second back band.

8. The bra of claim 5 further comprising a first adjustable shoulder strap with a first end attached to the first bra cup and a second end attached to the first back band, and a second adjustable shoulder strap with a first end attached to the second bra cup and a second end attached to the second back band.

* * * * *